United States Patent [19]

Haekkinen

[11] Patent Number: 4,567,708

[45] Date of Patent: Feb. 4, 1986

[54] METHOD FOR LEVELLING SUNKEN OR BROKEN PORTIONS OF EARTH-SUPPORTED FLOORS AND SLABS

[76] Inventor: Veikko Haekkinen, Portaankorvankatu 5, SF-33800 Tampere 80, Finland

[21] Appl. No.: 536,401

[22] Filed: Sep. 27, 1983

[30] Foreign Application Priority Data

Sep. 27, 1982 [FI] Finland ..... 823299

[51] Int. Cl.[4] ..... E04B 1/00

[52] U.S. Cl. ..... 52/743; 404/78

[58] Field of Search ..... 52/743; 404/78; 264/46.6, 46.5

[56] References Cited

U.S. PATENT DOCUMENTS 2,041,266 5/1936 Poulter ..... 404/78
4,240,995 12/1980 Milne ..... 264/36
4,470,719 9/1984 Dziark et al. ..... 404/75

FOREIGN PATENT DOCUMENTS 600104 6/1978 Fed. Rep. of Germany ..... 52/743
1033353 6/1966 United Kingdom .
2037349A 7/1980 United Kingdom .
1602859 11/1981 United Kingdom .

*Primary Examiner*—Carl D. Friedman
*Assistant Examiner*—Naoko N. Slack
*Attorney, Agent, or Firm*—Pollock, Vande Sande & Priddy

[57] ABSTRACT

The method relates to levelling sunken or broken portions of earth-supported floors or slabs (2, 2A). At least one hole (1) is made in the floor, and polyurethane foam is sprayed between the floor and the underlying earth through this hole. The foam creates in the space a mould pressure, which raises the floor.

7 Claims, 1 Drawing Figure

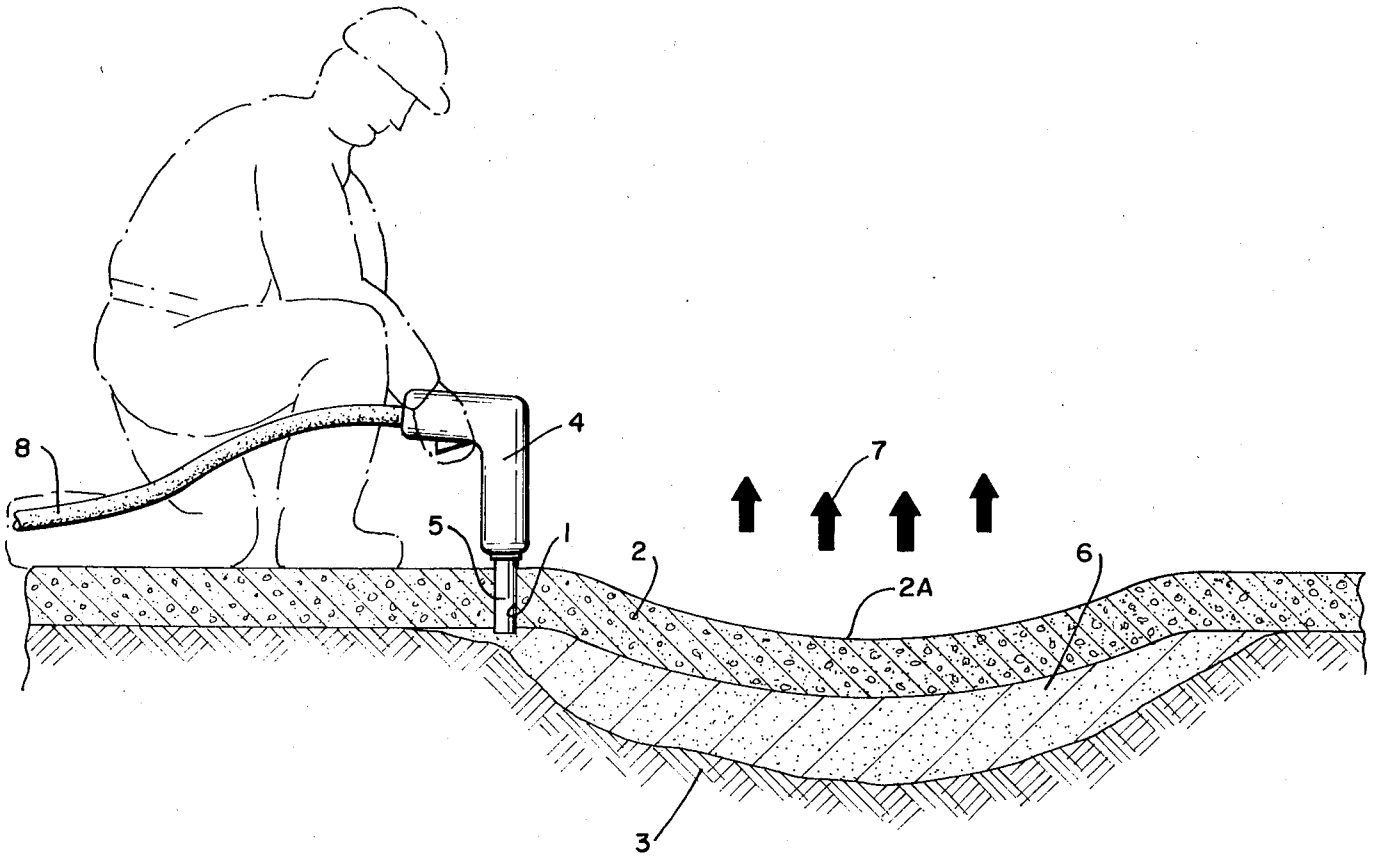
6
7
2A
2
3
4
1
5
8

METHOD FOR LEVELLING SUNKEN OR BROKEN PORTIONS OF EARTH-SUPPORTED FLOORS AND SLABS

DESCRIPTION

1. Technical Field

The invention relates to methods for levelling earth-supported floor and slabs. More particularly, the invention concerns such methods in which a grout of some sort is forced beneath the floor to raise it to the desired position.

2. Background Art

Earth-supported concrete floors and slabs, whether or not they have been reinforced with steel rods, wire mesh or the like, have been observed in some cases after the concrete has set fully to tilt as a whole from the desired level position, to break along a crack extending through the floor or slab and produce a tilted portion or portions, and to settle in localized portions, without breaking, into the underlying earth. Such tilting, breaking or settling may be caused by improper preparation of the earth prior to pouring the concrete, such as insufficient compacting of the earth. Or, undetected or ignored ice in the underlying earth can melt later and create softened earth into which the set concrete moves. Whatever the cause, such tilting, breaking or settling spoils the quality of the floor or slab. Technical difficulties can arise if there is a network of plumbing pipes or electrical wireways in the floor, due to the change in inclination.

In some instances, a suitable repair can be done by merely pouring more concrete onto the sunken or broken portion of the floor or slab. Of course, if equipment or furniture had already been placed on this portion prior to its sinking or breaking, such would have to be moved. And, if the floor is in the interior of a home or other structure, the moisture given off while the additional concrete sets may be undesirable. Attempts have also been made to pump concrete grout beneath the sunken or broken portion; however, such techniques typically require that the sunken or broken portion be lifted somehow before the grout is pumped in.

DISCLOSURE OF THE INVENTION

The primary object of the invention is to provide an improved, yet simple and reliable method for levelling floors and slabs made from concrete or similar materials, particularly when such floors or slabs are supported on the earth or a similar substrate.

Another object of the invention is to provide such a method in which the rate and amount of upward movement of the sunken or broken portion can be rather easily controlled.

Still another object is to provide such a method in which there is usually no need to move stationary equipment or furniture located on the sunken or broken portion.

These objects of the invention are provided only by way of example. Thus, other desirable objects and advantages inherently achieved by the disclosed method may occur or become apparent to those skilled in the art. Nonethless, the scope of the invention is to be limited only by the appended claims.

According to the invention, the components of an expanded polymeric foam, such as a closed cell polyurethane foam, are injected beneath the sunken or broken portion of an earth supported floor or slab. Usually, the space between the floor or slab and the earth is reached by drilling at least one hole through the floor or slab and injecting the components of the foam through the hole.

As the foam expands between the earth and the floor or slab, a mould pressure of up to 0.4 $MN/m^2$ is created, which forces the sunken or broken portion to rise. The amount and rate of upward movement can be held within appropriate limits by controlling the quantity of the components injected at a given time. The height of the sunken or broken portion is measured in any suitable fashion, prior to a further injection of components for the foam. The reaction or expansion time of the components typically is twenty to thirty seconds from the time the components are injected beneath the floor or slab. The hardened foam serves as a support for the previously sunken portion and as a thermal insulation.

The method according to the invention has numerous advantages. The degree of levelling of the floor or slab can be easily monitored as the foam forces it upward, thus ensuring a reasonably accurate final position. The rate at which the floor or slab rises can be regulated to be as slow and steady as desired, by controlling the quantity of foam injected at a given time. In general, though, the process is quite fast to complete. The overall area of the floor or slab does not affect steadiness and controllability of the levelling method. The hardened foam fills the space between the holes made for injecting the components of the foam; so that, the loads applied to the floor are transmitted directly to the underlying earth. There is no need to entirely remove any floor covering which may be on the sunken or broken portion. The overall weight of the concrete floor or slab is not increased and no undesirable humidity is created in the structure. Since stationary equipment or furniture usually need not be moved, the normal activity on the slab or floor can continue substantially unimpeded while the method of the invention is in use.

BRIEF DESCRIPTION OF THE DRAWING

The single FIGURE illustrates schematically how, in accordance with the method of the invention, a layer of polymeric foam is injected through an opening in a floor or slab to raise a nearby sunken or broken floor.

BEST MODE FOR CARRYING OUT THE INVENTION

Before the method of the invention is used, a topographical survey is made of the floor or slab to be levelled, to determine accurately those portions requiring attention. Where some portions of the concrete or other material have settled without breaking into the underlying earth and then hardened, the method can be used if the material has sufficient residual elasticity to deform upwardly without breaking. Otherwise, more concrete or other material must be placed in the settled area. Where some portion of the floor or slab, after hardening, has broken along a break line or crack extending through the floor or slab, the method can be used and the foam will seal the crack. Where the hardened floor or slab tilts as a whole, the method can be used.

Referring now to the drawing, those skilled in the art will understand the method according to the invention. At least one hole 1, though often a plurality are needed, is drilled through the floor or slab 2 at the sunken or broken portion 2A, and on through any underlying layers of insulation (not shown) to the interface between the soil 3 and the floor or slab. Where a plurality of holes 1 are used, they preferably are about 1.0 m from each other around the portion 2A. In some instances, it may be possible to reach the interface between the floor or slab and the earth by drilling laterally through an associated foundation or retaining wall; however, for simplicity this has not been shown.

A conventional foam spraying apparatus 4, having a nozzle 5 sized to fit closely in holes 1, is then used to inject the components of the foam beneath the floor or slab. Apparatus 4 is connected to a hose 8, leading to a conventional high pressure mixer in which the components of the foam are mixed. A preferred foam is formed from two components. The first component may be a ready blended polyol mixture comprising a polyether-polyol, catalysts and water, such as type RM109 made by Baxenden Chemicals of Denmark or type AL369 Resifoam made by Resina Chemie of Holland. The second component may be an MDI isocyanate, such as Desmador made by Bayer A.G. of Germany. The mixture of these two components produces a polyurethane foam having a density of 30 to 60 $Kg/m^3$, a compressibility of 2 to 5 $KP/cm^2$, a cell void diameter of 0.05 to 0.5 mm and at least 90% closed cells, as determined by the Remington method. Of course, other foams having similar properties in their hardened state and being suitable for injection in the manner described, may also be used without departing from the scope of the invention.

The levelling of the floor or slab preferably is performed in increments. For example, an area of about five square meters is provided with holes 1 and a sufficient quantity of the components of the foam is injected to cause about one centimeter of upward movement, as indicated schematically by arrows 7. A level, taut string, mason's level or other suitable device (not shown) is used to measure the upward movement. Injection of the components is repeated as necessary to further raise the sunken or broken portion, and the measurements are repeated. The alternating injections and measurements are continued until the floor or slab is satisfactorily level. If desired, measurements may be made while the sunken or broken portion is rising, rather than waiting for movement to cease following each injection.

Having described my invention in sufficient detail to enable those skilled in the art to practice it, I claim:

1. An improved method for levelling sunken or broken portions of earth-supported floors and slabs, comprising the steps of:

mixing components to form an expandable polymeric foam mixture; and injecting the unexpanded mixture of said components beneath a sunken or broken portion of an earth-supported floor or slab, whereby the expansion of said foam between said portion and the earth creates a mould pressure which raises said portion toward a position level with the remainder of said floor or slab.

2. A method according to claim 1, wherein said foam is a closed cell polyurethane foam.

3. A method according to claim 1, wherein said floor or slab is supported by an insulation layer resting on the earth and said mixture is injected between said insulation layer and the earth.

4. A method according to claim 1, further comprising the steps of:

drilling at least one hole through said floor or slab at said sunken or broken portion; and injecting said mixture through said at least one hole.

5. A method according to claim 4, wherein a plurality of holes are drilled around said sunken or broken portion.

6. A method according to claim 1, further comprising the step of measuring the elevation of said sunken or broken portion following said expansion, to monitor the return of said portion to a position level with the remainder of said floor or slab.

7. A method according to claim 6, wherein said injecting is terminated while said measuring is completed, after which more of said mixture may be injected to further raise said sunken or broken portion.

* * * * *